US005180191A

United States Patent [19]

Biba

[11] Patent Number: 5,180,191

[45] Date of Patent: Jan. 19, 1993

[54] BAND FOLDER WITH INTEGRAL HANDLES

[75] Inventor: Gregory A. Biba, Janesville, Wis.

[73] Assignee: G. LeBlanc Corporation, Kenosha, Wis.

[21] Appl. No.: 837,534

[22] Filed: Feb. 14, 1992

Related U.S. Application Data

[63] Continuation of Ser. No. 681,553, Apr. 5, 1991, abandoned.

[51] Int. Cl.[5] ..... B42D 17/00

[52] U.S. Cl. ..... 281/45; 281/20; 281/31; 281/51; 229/1.5 R; 229/68 C; 229/72; 383/10

[58] Field of Search ..... 281/43, 45, 20, 31, 281/51, 49; 229/1.5 R, 68 C, 72; 383/10

[56] References Cited

U.S. PATENT DOCUMENTS

| | | | |
|---|---|---|---|
| 492,238 | 2/1893 | Samson | 281/49 |
| 1,306,149 | 6/1919 | Johnson | 383/10 |
| 1,418,001 | 5/1922 | Kniep | 383/10 |
| 3,516,599 | 6/1970 | Buttery | 229/72 |
| 4,703,952 | 11/1987 | Biasini | 281/45 |
| 4,913,463 | 4/1990 | Tlapek et al. | 281/49 |
| 4,934,584 | 6/1990 | Wyant | 229/1.5 R |
| 5,028,075 | 7/1991 | Donnelly | 281/45 |

FOREIGN PATENT DOCUMENTS

| | | | |
|---|---|---|---|
| 1589159 | 4/1970 | France | 383/10 |
| 2309419 | 11/1976 | France | 383/10 |

*Primary Examiner*—P. W. Echols
*Assistant Examiner*—David P. Bryant
*Attorney, Agent, or Firm*—Trexler, Bushnell, Giangiorgi & Blackstone, Ltd.

[57] ABSTRACT

A folder comprises a plurality of joined panels having a first surface and a second surface. An aperture is disposed through each of the joined panels, communicating from the first surface to the second surface. The aperture is of sufficient size to accept a human finger, so that a person can easily carry and manipulate the folder by utilization of the aperture. The aperture has reinforcement, and a pocket for retaining material.

6 Claims, 1 Drawing Sheet

BAND FOLDER WITH INTEGRAL HANDLES

This application is a continuation of application Ser. No. 07/681,553, filed Apr. 5, 1991, now abandoned.

BACKGROUND AND SUMMARY OF THE INVENTION

The present invention relates generally to a document container, useful for holding documents, papers, and the like, having a new, uniquely constructed, translation means which facilitates transport of the container, and also assures that the contents of the container will remain therein. More specifically, the invention relates to a band folder.

Band folders, and other similar devices, have been employed for many years, and their construction is well known. The band folders are used primarily to store, protect, and transport sheet music, workbooks, papers, and the like. Band folders are used primarily by music students and musicians.

The general structure of a band folder is well known in the art. The band folder is formed from a substantially planar blank of a substantially rigid material, such as card stock, light cardboard, and the like. Preferably, the material composing the blank is substantially more rigid than the material composing the expected contents of the band folder. Portions of the blank are transformed or removed to create operative elements of the band folder.

First, the dimensions of the band folder are chosen. Because band folders are constructed to accommodate sheet music, the size of the band folder must correspond to that of sheet music. Thus, many band folders are, approximately, twelve inches in width, and fourteen inches in length. Of course, if the folder is to be employed with other material of different dimensions as its contents, the dimensions of the band folder can be adjusted accordingly to compensate.

The blank forming the band folder is often creased or folded along a vertical center line, or other line thereof, so as to form a plurality of panels comprising the band folder. With the blank so folded, the band folder opens and closes like a book. Pockets, or other material retention means, are disposed in the interior of the band folder, so that the band folder can retain its contents therein. Gravity often biases the contents, thereby keeping the contents in a proper disposition in the pockets, but this is dependent upon the proper orientation of the band folder. The pockets can take on a variety of forms, dependent upon the nature and construction of the material to be held therein. The number of pockets usually corresponds to the number of panels comprising the band folder.

Band folders of the past have been very popular, primarily due to their ability to organize, store, and protect material therein. Also, the exterior surface of the band folders can bear some graphic design in printed form, thereby increasing the aesthetic appeal of the band folders. School age children may often purchase band folders due to the particular graphics displayed thereon. Adults as well have similar buying habits, for instance, purchasing band folders that depict a certain place they have visited, or a certain event they have attended.

Even these band folders, however, have certain drawbacks. The contents are held within the pockets by gravitational forces. Therefore, the effectiveness of the band folder in retaining its contents is dependent upon the orientation of the band folder. If the bottom edge of the band folder opposes the ground, usually no problem arises. However, if the opposite edge of the band folder opposes the ground, the contents will be drawn out of the pockets by gravity, and spill onto the floor. This is highly undesirable. This drawback takes on added significance because people utilizing band folders often have other items in their arms. For instance, a music student is often carrying, in addition to a band folder, a stack of books, and an instrument case bearing an instrument. Also, due to the overall substantially planar construction of the band folders, they are not easy to grip and carry, considering the other things that a person must also carry.

A new, novel construction of band folders is desired that varies from the overall, substantially planar constructions found in the prior art. Specifically, such a construction will include carrying means which can facilitate easy gripping and transportation of the band folder. Also, the new construction would assist in insuring that the band folder remains in a disposition which can maintain the effectiveness of the pockets, or other retention means, in retaining the contents of the band folder in the interior thereof when the band folder is transported.

OBJECTS AND SUMMARY OF THE INVENTION

A general object of the present invention is to provide a new, novel, and unique design for document containers, especially band folders.

Another object of the invention is to provide a band folder having carrying means which facilitate in transport of the band folder.

A further object of the present invention is to provide a band folder having apertures, which function as handles, in panels thereof which are of sufficient size to accept human fingers.

An additional object of the invention is to provide a band folder having handle apertures which are disposed above a horizontal center line of the band folder.

Another object of the present invention is to provide a band folder having handle apertures wherein at least one edge of the handle apertures has reinforcement, thereby strengthening the handle apertures.

A further object of the invention is to provide a band folder or document container having translation means capable of orienting the container with respect to the ground when the means is utilized so as to increase the effectiveness of the container in maintaining its contents in an interior thereof.

A band folder, in accordance with the present invention, comprises a plurality of joined panels having a first surface and a second surface. At least one aperture is disposed through at least one of the joined panels, communicating from the first surface to the second surface. The aperture is of sufficient size to accept a human finger, so that a person can easily translate and manipulate the document container by means of the aperture. The aperture has reinforcing means, and means for retaining material are located in the document container.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
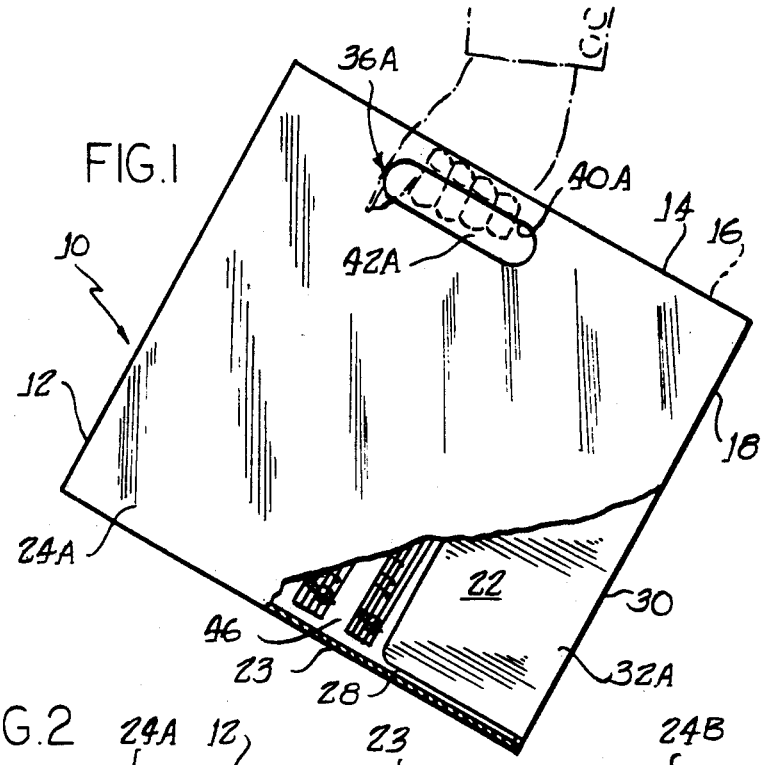
FIG. 1 is a side elevational view of a band folder, constructed according to the teachings of the present invention, with portions thereof being broken away to show the disposition of the band folder, and its contents, during transport.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. While the invention will be discussed with reference to a two-panel construction, it is to be understood that the teachings of the present invention can be employed with other numbered panel constructions.

Figure 2:
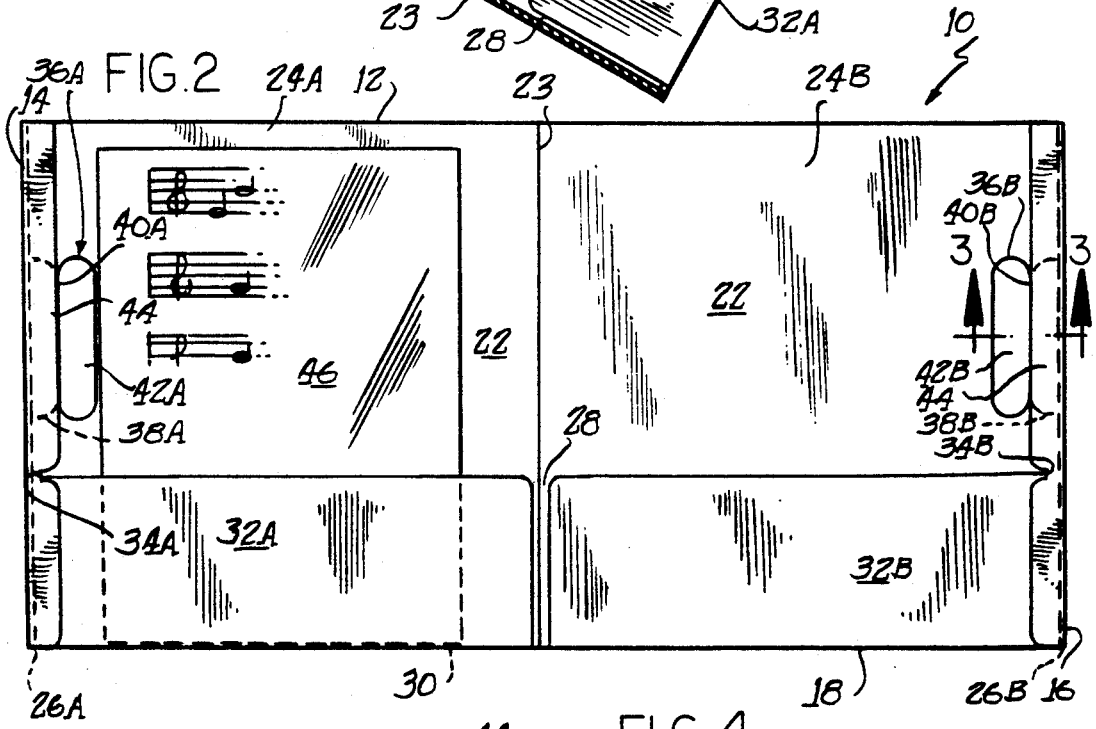
FIG. 2 is a front elevational view showing the internal construction of the band folder, with a paper disposed within the material retention means.
Figure 3:
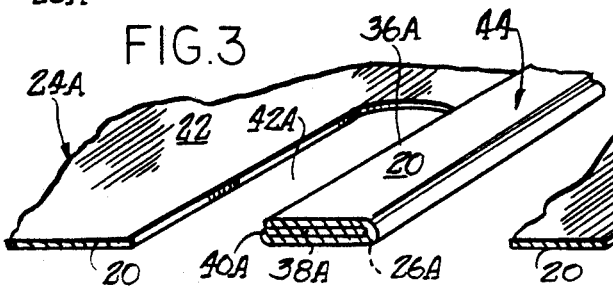
FIG. 3 is a sectional view, taken along line 3—3 of FIG. 2, showing the disposition of elements of the reinforcement of the carrying means.

Referring initially to FIG. 2, a document container or band folder 10 , constructed according to the teachings of the present invention, is shown. The band folder 10 is constructed from a substantially planar blank of a stiff material, such as card stock, light-weight cardboard, or the like. The material composing the band folder 10, preferably, has a stiffness that is greater than that of the material comprising the contents of the band folder 10. Thus, if the contents of the band folder 10 is to be composed of sheet music or papers, or other similar materials, then the above-disclosed materials would serve aptly to compose the band folder 10.

In order to form the band folder 10 from the blank, the desired dimensions must be chosen. To do this, the particular size of the contemplated contents of the band folder 10 must be considered. It is desirable to choose the dimensions of the band folder 10 so that the band folder 10 can completely cover, and thereby protect, the contents. For instance, if sheet music comprises the desired contents, then the band folder 10 should be folio size (i.e. 12 inches by 14 inches), however, modern sheet music is smaller in size than older sheet music, so the band folder can be somewhat smaller than folio size. Once these dimensions have been chosen, the detailed construction of the band folder 10 can begin.

The blank is cut initially to form at least four edges: a top edge 12, juxtaposed side edges comprising a first side edge 14, and a second side edge 16, and a bottom edge 18. The top edge 12 opposes the bottom edge 18, and the first side edge 14 opposes the second side edge 16, as shown in FIG. 2. In the particular construction depicted in FIG. 1 through 4, the top edge 12 is substantially straight, substantially perpendicular to the first and second side edges 14 and 16, and substantially parallel to the bottom edge 18. The first side edge 14 and the second side edge 16 are mutually parallel, and both are substantially perpendicular to the top edge 12 and the bottom edge 18. All of the edges 12 through 18 are essentially straight and linear in construction. However, different constructions of the edges 12 through 18, either wholly or independently, can be utilized to satisfy personal taste, or to accommodate contents of varying configurations.

The band folder 10 has at least a first surface 20 and a second surface 22, which are substantially planar in configuration. The first surface 20 is often printed with various graphics, in order to increase the aesthetic appeal of the band folder 10. For instance, musical scales, or bars of practice music can be printed on the first surface 20 in order to increase not only aesthetic appeal, but also the utility of the band folder 10. In some constructions, other ornamentation, some of which may cause the first surface 20 to vary from the generally planar construction, is disposed about the first surface 20. In further embodiments, the first surface 20 is laminated with protective material, such as a thin plastic film, so as to protect the band folder 10 from the effects of a possibly hostile ambient environment (e.g. rain). The second surface 22 may also bear certain graphic designs, such as musical scales, sections of practice music, and the like, in printed form or otherwise. The second surface 22 is constructed so as to confront and to protect the contents of the band folder 10.

As shown in FIG. 2, the band folder 10 has a vertically projecting center line 23 which divides the band folder 10 into a plurality of panels. The particular construction disclosed herein involves two panels 24A and 24B of equal dimension. The band folder 10 can be creased and folded along this center line 23 so that the band folder 10 can open and close like a book. Specifically, the band folder 10 is folded on the center line 23 so that a portion of the second surface 22 contained on the panel 24A confronts the portion of the second surface 22 contained on the panel 24B, as shown in FIG. 1. In this manner, the contents of the band folder 10 will be covered and protected by both of the panels 24A and 24B.

The top edge 12 determines an upper terminal end of the band folder 10, and is finite in length, as determined by the size of the desired contents. Portions of the first side edge 14 and the second side edge 16 which extend beyond the desired length of the top edge 12 are creased along crease lines 26A and 26B which extend from both terminal ends of the top edge 12, substantially perpendicularly to the top edge 12 downwards, to the bottom edge 18.

Preferably, the extension of the first side edge 14, the second side edge 16, and the bottom edge 1 8 is larger than the desired length of the band folder 10. Thus, portions of the first and second side edges 14 and 16 which extend beyond the desired length of the band folder 10 and extend beyond the crease lines 26A and 26B are folded over.

The bottom edge 18 is also disposed on the panels 24A and 24B a certain distance below the desired length of the band folder 10. A portion of the panels 24A and 24B, proximate to the bottom edge 18, which extends beyond the desired distance of the band folder 10 is creased along a crease line 30, which extends from the crease line 26A along the first side edge 14 to the crease line 26B along the second side edge 16. A portion of the panels 24A and 24B, centered about the center line 23 and extending between the crease line 30 and the bottom edge 18 of the band folder 10, is cut away to form a slot 28. The portions cut away from the first and second side edges 14 and 16, and the bottom edge 18, can be collected and recycled. The portions of the panels 24A and 24B now form flaps 32A and 32B, which are folded along the crease line 30 so that the second surface 22 of the flaps 32A and 32B confront the second surface 22 of the panels 24A and 24B, respectively. In this construction, the flaps 32A and 32B form pocket means or means for retaining material inside the band folder 10.

The flaps 32A and 32B extend upwards from the crease line 30 towards the top edge 12 a certain distance. Now, the bottom edge 18 is disposed between the crease line 30 and the top edge 12. Portions, centered about the bottom edge 30, of the first and second side edges 14 and 16, are removed to form scallops 34A and 34B, as shown in FIG. 2. The function of the scallops 34A and 34B will become more clear herein.

The band folder 10 also has carrying means or handles 36A and 36B. The construction of the handles 36A and 36B will become apparent in the following discussion. First, the location of the handles 36A and 36B is carefully chosen. The handles 36A and 36B, preferably, are located proximate to the first and second side edges 14 and 16 on the panels 24A and 24B. This is desirable so that utilization of the handles 36A and 36B will not cause damage to the contents of the band folder 10. Other locations for the handles 36A and 36B can also be chosen. It is also important to coordinate the location of the handles 36A and 36B on the panels 24A and 24B respectively so that the handles 36A and 36B will line up when the band folder 10 is folded along the center line 23. More importantly, it is desirable to locate the handles 36A and 36B offset upwardly with respect to a horizontal center line of the band folder 10. The purpose and function of this disposition will become apparent herein.

Figure 4:
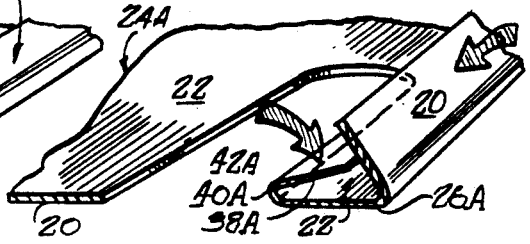
FIG. 4 is a sectional view, similar to that of FIG. 3, showing the disposition of elements of the reinforcement of the carrying means during construction of the band folder.

With the location of the handles 36A and 36B thus chosen, the construction thereof can begin. The disclosure of the construction of the handles 36A and 36B will refer to only one thereof, for the same process is implemented with respect to the other handle. As shown in FIG. 4, a piece 38 of a panel 24A or 24B is cut. Specifically, the piece 38 is cut from the panel 24A or 24B in such a manner so that the piece 38 still remains attached to the panel 24A or 24B along at least one edge 40 of the piece 38. Preferably, the edge 40 opposes the first or second side edges 14 or 16, respectively, depending upon which panel 24A or 24B the edge 40 is disposed upon.

The piece 38 is creased and folded along the edge 40 so that the second surface 22 of the piece 38 confronts the second surface 22 of the panel 24A or 24B, thereby leaving a hand hole or an aperture 42 in the panel 24A or 24B. The edge 40 defines one side of the aperture 42. At the same time, the portions of the first or second side edges 14 or 16 which extend beyond their respective crease lines 26A or 26B are also folded so that the second surface 22 of the first or second side edges 14 or 16 confronts the second surface 22 of the panel 24A or 24B, as shown in FIG. 4.

To complete the construction of the handles 36A and 36B, the piece 38 is folded over first, so that the second surface 22 of the piece 38 confronts and engages the second surface 22 of the panel 24A or 24B. Then, the first or second side edges 14 and 16 are folded over, so that the second surface 22 of the first or second side edges 14 or 16 confronts and engages the first surface 20 of the piece 38. In this manner, as shown clearly in FIG. 3, one side of the aperture 42, and thereby the handles 36A and 36B, enjoys the structural benefits of a three-ply construction resulting in reinforcing means 44. In some constructions, an adhesive layer is provided which insures firm interengagement between the second surface 22, the piece 38, and the first or second side edges 14 or 16. The reinforcing means 44 adds to the structural integrity of the handles 36A and 36B, and assures that the handles 36A and 36B will not easily tear under the stresses generated by transporting the band folder 10 when contents are disposed therein.

The function of the band folder 10, and the elements thereof, will become more clear in the following discussion. The contents of the band folder 10 are placed within the band folder 10, as shown in FIG. 2. Specifically, the contents, designated by the piece of paper 46, are inserted behind the flaps 32A and/or 32B, so that the piece of paper 46 confronts the second surface 22 of the panels 24A or 24B, respectively. One edge of the piece of paper 46 opposes an edge of the aperture 42 opposite to the edge 40 of the piece 38. This is to insure that no damage will accrue to the piece of paper 46 due to utilization of the handles 36A and 36B. A bottom edge of the piece of paper 46 opposes and contacts the crease line 30, and the scallops 34A and 34B allow for expansion of the flaps 32A and 32B, respectively, so that the flaps 32A and 32B can retain larger amounts of contents.

To transport the band folder 10, first the band folder 10 is folded along the center line 23 so that the second surface 22 of the panel 24A confronts the second surface 22 of the panel 24B. When folded along the center line 23, the aperture 42A in the panel 24A aligns with the aperture 42B, thereby completing the carrying means. A person can insert his fingers through the apertures 42A and 42B, and transport and manipulate the band folder 10 easily by means of the handles 36A and 36B.

As shown in FIG. 1, when a person utilizes the handles 36A and 36B to transport the band folder 10, the location of the handles 36A and 36B performs a highly desirable function. Because the handles 36A and 36B, or portions thereof, are offset upwardly from a horizontal center line of the band folder 10, the band folder 10 tends to pivot approximately 30 degrees with respect to the horizontal under the influence of gravitational forces. With the band folder 10 so pivoted, gravity biases the piece of paper 46 against the crease line 30, thereby holding the piece of paper 46 firmly within the flaps 32A and 32B, and within the band folder 10. By so pivoting, the piece of paper 46 is prevented from spilling out of the band folder 10.

The band folder 10, constructed according to the teachings of the present invention, is a highly desirable advancement in the construction of band folders, and document containers in general. Specifically, the band folder 10 of the present invention allows one to carry the band folder 10 like a small satchel of a briefcase. This is particularly advantageous to people, such a school children and businessmen alike, who often have a plurality of things to carry at once. Additionally, the band folder 10 provides a construction which keeps the contents thereof firmly inside the band folder 10, without the need of paper clips, or other, auxiliary attaching devices. Also, to facilitate construction of the band folder 10, it is possible to die cut the blank, thereby decreasing assembly time.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A band folder for retaining material, such as sheet music, useful in musical arts comprising: a plurality of joined panels each having a free top edge, a free bottom edge, a joined side edge along which the panels are joined and a free side edge opposing the joined side edge; an aperture disposed through each of the joined panels adjacent its free side edge, with the apertures being in conjunctive alignment with each other and being offset upwardly with respect to a center line of the band folder for providing carrying means said center line being parallel to said free bottom edge; the carrying means being of dimensions sufficient for accepting a user's finger; means for retaining material disposed adjacent the free bottom edge of at least one of the joined panels; and the carrying means being located for promoting retention of material in the means for retaining material and so that the user's finger embraces the free side edges of of the joined panels when a user carries the band folder by the carrying means.

2. A band folder as defined in claim 1 wherein the means for retaining material comprises a portion of said at least one joined panel transformed to a flap.

3. A band folder as defined in claim 2 wherein scallops are disposed proximate to the means for retaining material for allowing the means for retaining material to expand to hold additional material.

4. A band folder as defined in claim 1 wherein at least one edge of each aperture is defined by reinforcing means for increasing the structural integrity of the aperture.

5. A band folder as defined in claim 4 wherein the reinforcing means comprises a piece of material removed from each panel to form each aperture, and a portion of each free side edge; and each said piece and said portion is folded over into interengagement with its respective panel.

6. A band folder as defined e 2 wherein the flap terminates at a slot adjacent said free side edge; the slot allowing for flap expansion, and easy removal of material from the band folder.

* * * * *

UNITED STATES PATENT AND TRADEMARK OFFICE

CERTIFICATE OF CORRECTION

PATENT NO. : 5,180,191

DATED : January 19, 1993

INVENTOR(S) : Gregory A. Biba

It is certified that error appears in the above-identified patent and that said Letters Patent is hereby corrected as shown below:

Column 8, line 21, "A band folder as defined e 2 wherein the flap"

should read --A band folder as defined in claim 2 wherein the flap--

Signed and Sealed this

Eighteenth Day of January, 1994

*Attest:*

Bruce Lehman

BRUCE LEHMAN

*Attesting Officer*

*Commissioner of Patents and Trademarks*